US007896267B2

(12) United States Patent
Ishigaki et al.

(10) Patent No.: US 7,896,267 B2
(45) Date of Patent: Mar. 1, 2011

(54) DISPERSING OR MILLING APPARATUS, AND DISPERSING OR MILLING METHOD USING SAME

(75) Inventors: Takamasa Ishigaki, Tsukuba (JP); Ji-Guang Li, Shenyang (CN); Kimitoshi Sato, Aichi-ken (JP); Hidehiro Kamiya, Tokyo (JP); Yoshitaka Inoue, Tokyo (JP); Choji Hatsugai, Utsunomiya (JP); Takashi Suzuki, Isehara (JP)

(73) Assignee: National Institute for Materials Science & Inoue Mfg., Inc. (JP)

( * ) Notice: Subject to any disclaimer, the term of this patent is extended or adjusted under 35 U.S.C. 154(b) by 338 days.

(21) Appl. No.: 12/070,324

(22) Filed: Feb. 14, 2008

(65) Prior Publication Data

US 2008/0197218 A1 Aug. 21, 2008

(30) Foreign Application Priority Data

Feb. 20, 2007 (JP) ..... 2007-039179

(51) Int. Cl.
*B02C 19/16* (2006.01)

(52) U.S. Cl. ..... 241/1; 241/170

(58) Field of Classification Search ..... 241/1, 241/21, 69, 170–172, 275
See application file for complete search history.

(56) References Cited

U.S. PATENT DOCUMENTS

| | | | | |
|---|---|---|---|---|
| 4,919,347 | A | 4/1990 | Kamiwano et al. | 241/65 |
| 5,257,742 | A * | 11/1993 | Yashima et al. | 241/65 |
| 5,593,097 | A * | 1/1997 | Corbin | 241/21 |
| 5,918,819 | A * | 7/1999 | Rabinovich et al. | 241/5 |
| 6,585,180 | B2 * | 7/2003 | Inoue | 241/171 |
| 7,699,250 | B1 * | 4/2010 | Jones | 241/30 |
| 2001/0042803 | A1 * | 11/2001 | Inoue | 241/171 |
| 2003/0168538 | A1 * | 9/2003 | Dobson | 241/21 |

FOREIGN PATENT DOCUMENTS

| | | |
|---|---|---|
| JP | 04070050 | 7/1989 |
| JP | 2000351916 | 12/2000 |

* cited by examiner

*Primary Examiner*—Faye Francis
(74) *Attorney, Agent, or Firm*—Adams & Wilks

(57) ABSTRACT

A material to be treated containing solid particles in a liquid is stirred together with milling media, and irradiated with ultrasonic waves during stirring to finely mill the solid particles to nanometer size and disperse the solid particles in the liquid. The ultrasonic waves create cavitation in the liquid and upon decay of the cavitation, shock waves are produced that cause the solid particles to vigorously collide with one another and with the milling media and these collisions, together with the shearing forces created by collision of the milling media, can produce on a commercial scale nano particles having an average particle size of at most 100 nm.

2 Claims, 4 Drawing Sheets

DISPERSING OR MILLING APPARATUS, AND DISPERSING OR MILLING METHOD USING SAME

FIELD OF THE INVENTION

The present invention relates to an apparatus and method for dispersing and milling solid particles contained in a liquid to obtain solid particles of nanometer size blended with the liquid.

BACKGROUND INFORMATION

Apparatuses for finely milling solid particles in a material to be treated (mill base) by the use of milling media (beads) and dispersing or milling the particles in a liquid, have been known. As such apparatuses, bead mills (wet-type media-dispersing apparatus, media mill, etc.) using beads on the order of millimeter (mm) size as milling media, have been widely used. In apparatuses used for practical production, the material to be treated, which is typically a slurry of solid particles in a liquid, is stirred together with beads, and the solid particles are milled by the shearing action of the beads and dispersed in the liquid to obtain particles finely divided to submicron size.

However, with bead mills using beads of mm size, it is difficult to obtain extremely fine nano particles with a particle size of at most 100 nanometer, which have been demanded in recent years. The reason is that it is difficult to apply uniform shearing forces to nano particles. Accordingly, bead mills using beads of a few tens μm have been recently developed on a laboratory scale to make it possible to apply more uniform shearing forces to nano particles, whereby it becomes possible to conduct milling and dispersion to nearly obtain a primary particle size of nanometer size in the laboratory.

On the other hand, ultrasonic dispersing apparatuses are known that are used for dispersion in a liquid/liquid system for, e.g., production of emulsion, or milling and dispersion of solid particles in a solid/liquid system. By this method, it is possible to impart a more uniform collision of the particles with one another, whereby at some low concentration range of particles or in a laboratory setting, it is possible to conduct milling and dispersion to a level to nearly obtain a primary particle size of nanometer size. In the ultrasonic dispersing apparatuses, collision of particles with one another can be promoted by shock waves generated during decay of cavitation, whereby it becomes possible to conduct milling and dispersion.

JP-A-2000-351916 describes a pigment-dispersing apparatus applicable at production level, combining the above-mentioned bead mill using beads of mm size and ultrasonic irradiation. More specifically, a media mill and a vessel are connected by a pipe, and a mixture of a liquid medium and solid pigments to be uniformly dispersed is circulated therethrough. The pressure in the vessel is reduced during the dispersing treatment, and an ultrasonic-generating mechanism is disposed at a part of the vessel. However, in the ultrasonic-generating mechanism used in such an apparatus or method, irradiation of the mixture with ultrasonic waves is conducted for the purpose of preventing sedimentation of a dispersion having the contents dispersed with the media mill, and not for obtaining nano particles uniformly milled and dispersed.

As mentioned above, with a bead mill using very fine beads of a few tens μm size, it becomes possible to conduct milling and dispersion to nearly a primary particle size of nanometer size in a laboratory setting, but there is a problem in that it is difficult to separate nano particles and beads of a few tens μm size dispersed in a liquid, and such apparatus cannot be used at practical production level. Further, when beads of mm size, for example, beads of 0.5 mm (500 μm), are used, it has been found that although separation of beads is possible, it is impossible to conduct milling and dispersion to nearly a primary particle size of nanometer size.

On the other hand, a method has been known in that milling and dispersion to the primary size level can be made by only irradiation with ultrasonic waves. However, in such a method, the conditions for sufficiently generating the collision of particles with one another are extremely narrow, and the range in which the propagated wave energy can be exerted is extremely narrow, whereby only a small amount of material can be treated. Accordingly, from the aspect of cost performance, such a method is hardly used for practical production.

Further, a method combining irradiation with ultrasonic waves and a bead mill has been proposed as mentioned in the above JP-A-2000-351916, but the irradiation with ultrasonic waves is conducted in a tank of a large capacity at practical production level, and no milling media (balls or beads) are contained in the tank, and therefore the extent of collision of particles with one another by irradiation with ultrasonic waves is insufficient to obtain finely milled solid particles. In order to mill solid particles and disperse them in a liquid by only the effect of irradiation with ultrasonic waves, there is no other way than making the tank extremely small, and such a method cannot be used for practical production due to low efficiency.

Various methods have been attempted as mentioned above, but there is still a problem that in the application for the purpose of milling and dispersing nano particles, such methods have not reached practical production level using beads of mm size.

SUMMARY OF THE INVENTION

An object of the present invention is to provide an apparatus and method for dispersing and milling a material containing a liquid and solid particles to obtain finely milled particles of nanometer size.

Another object of the present invention is to provide an apparatus and method for dispersing and milling a material containing a liquid and solid particles to obtain finely milled particles of nanometer size and that can be economically used on a commercial scale and that overcome the aforementioned problems of known apparatuses and methods.

A further object of the present invention is to provide an apparatus and method for dispersing and milling a material containing a liquid and solid particles to obtain finely milled particles of nanometer size and which utilize shock waves generated by ultrasonic waves to accelerate movement of milling media to improve dispersion and milling efficiency.

According to one aspect of the present invention, a dispersing or milling apparatus is characterized in that a material to be treated containing a liquid and solid particles blended therewith is stirred together with milling media, and irradiated with ultrasonic waves during stirring to finely mill the solid particles and disperse the solid particles in the liquid. The ultrasonic waves generate alternating low-pressure and high-pressure waves in the liquid, resulting in the formation and violent collapse of small vacuum bubbles. This phenomenon is termed cavitation, and the violent collapse of the small vacuum bubbles produce shock waves in the liquid. The particle size of the milling media is preferably about 15 μm to 1.0 mm, the frequency of the ultrasonic waves for irradiation is about 15 KHz to 30 KHz, and the amplitude of the ultrasonic waves for irradiation is about 5 μm to 50 μm.

The present invention also provides a dispersing or milling method wherein solid particles are dispersed or milled by using the above dispersing or milling apparatus.

In accordance with another aspect of the present invention, a material to be treated (mill base) containing a liquid and solid particles blended therewith is supplied to a vessel of a bead mill, the material is stirred together with milling media in the vessel so that the solid particles are finely milled and dispersed in the liquid, and an ultrasonic generator is disposed on the vessel to irradiate with ultrasonic waves the material to be treated and the milling media during stirring. The present invention also provides a dispersing or milling method wherein solid particles in the liquid are dispersed or milled by using the apparatus.

According to a further aspect of the present invention, a material to be treated containing a liquid and solid particles blended therewith is stirred together with milling media, and irradiated with ultrasonic waves during stirring to finely mill the solid particles and disperse the solid particles in the liquid, which is unlike the case where shearing forces are applied to solid particles in the material to be treated solely by the movement of milling media as conducted by use of a bead mill using beads of mm size and unlike the case where milling and dispersion are conducted by collision of solid particles with one another as made in an ultrasonic dispersing apparatus.

In the present invention, the shock waves generated by irradiation of the material with ultrasonic waves causes the aggregated nano particles to vigorously collide with one another and also causes the nano particles to vigorously collide against the milling media. This is particularly effective when the concentration of particles is low. At the same time, the milling media also receive the shock waves, which accelerates movement of the milling media. Since the milling media are vigorously stirred in the vessel, the milling media are thoroughly and energetically moved and strong shearing forces are generated by collision of the milling media with one another. The shearing forces generated by collision of the milling media, collision of the nano particles with one another and collision of the nano particles against the milling media act in corporation with one another to extremely finely mill the solid particles so as to obtain desired nano particles. The milling and dispersing apparatus can be used effectively at practical production levels.

Further, since the average particle size of nano particles thus obtained is at most about 100 nm, it is possible to separate the milling media therefrom by making the particle size of the milling media at least 15 μm, and the milling media can be accelerated and vigorously moved by shock waves generated by the ultrasonic waves by making the particle size of the milling media at most 1.0 mm. When the ultrasonic generator is disposed inside the vessel of the bead mill, the particle size of the milling media is preferably within a range of 0.5 mm to 1.0 mm by which classification of nano particles and beads can more assuredly be made and sufficient movement of the milling media by the shock waves can be made when the apparatus is used at practical production levels. When the ultrasonic generator is disposed in a tank functioning as both a supply tank and a recovery tank in the bead mill, there is no problem in practical production so far as the particle size of the milling media is any size within a range of 15 μm to 1.0 mm.

Further, when the frequency of ultrasonic waves is 15 KHz to 30 KHz and the amplitude is 5 μm to 50 μm, large cavitation can be securely generated, the shock waves produced upon decay of the cavitation become strong, and aggregated nano particles and milling media can be vigorously and thoroughly moved, so as to conduct sufficient dispersion and milling. More preferably, the frequency of ultrasonic wave is 15 KHz to 20 KHz and the amplitude is 20 μm to 50 μm.

BRIEF DESCRIPTION OF THE DRAWINGS

FIG. 1(A) and FIG. 1(B) show a bead mill of system A illustrating an example of the present invention, wherein FIG. 1(A) is a longitudinal cross-sectional view and FIG. 1(B) is a cross-sectional view along the line B-B in FIG. 1(A).

DETAILED DESCRIPTION OF THE INVENTION

The present invention may be applied to various kinds of bead mills (a wet-type medium-dispersing apparatus, a media mill, a bead-dispersing apparatus, etc.). Hereinbelow, systems A to D will be explained as specific illustrative examples.

Figure 1:
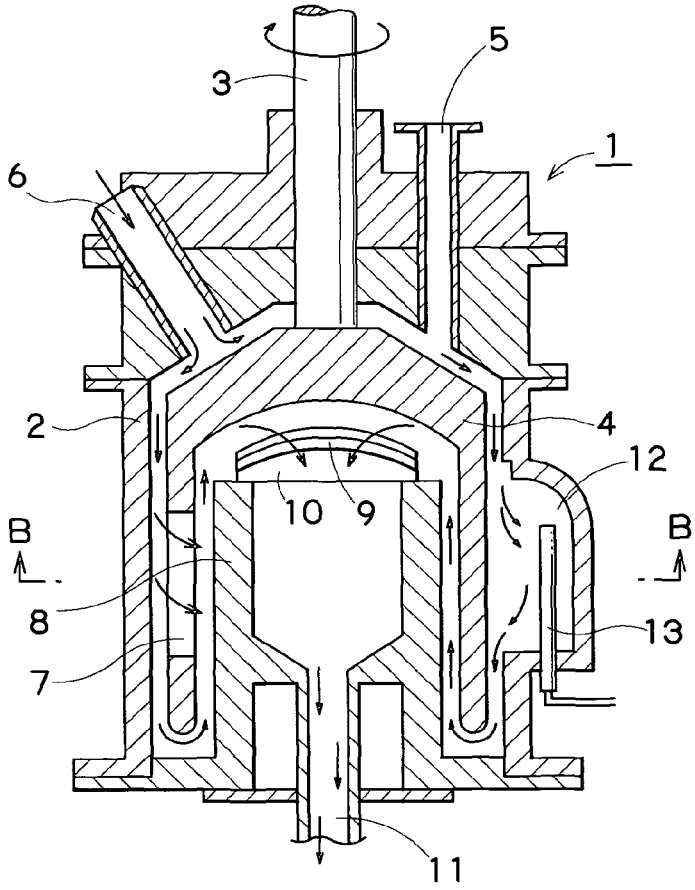
Figure 1:
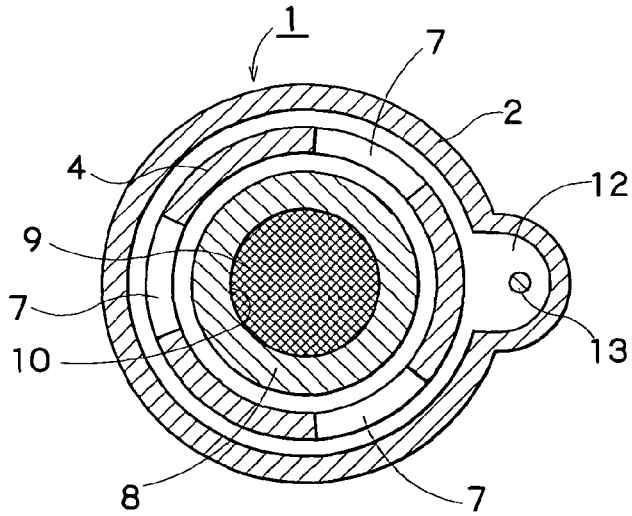

FIGS. 1(A) and 1(B) illustrate an example of System A. A bead mill 1 has a vessel 2 in which is rotatably disposed a rotor 4. The rotor 4 is connected to a driving shaft 3 which is rotationally driven by any suitable drive source (not shown) to rotationally drive the rotor 4. The vessel 2 has a milling media supply port 5 for introducing milling media, such as beads, balls and the like, into the vessel, and a material supply port 6 for introducing a material to be treated, such as a mill base or a slurry in the form of a mixture of solid particles and liquid, into the vessel 2.

The rotor 4 has a hollow, tubular shape with substantially smooth inner and outer surfaces. If desired, the inner and/or outer surfaces of the rotor 4 may be provided with a projection of appropriate shape to assist in moving the milling media and the material to be treated as the rotor 4 rotates. By way of example, the projection may be in the form of a guide member as illustrated in JP-B-4-70050 to assist in advancing the material to be treated through the vessel so that the material flows in a substantially plug-flow style. The rotor 4 is provided with one or more rotor opening ports 7 at appropriate locations to enable the milling media to circulate from the outside to the inside, and vice versa, of the tubular rotor 4.

A stator 8 is positioned inside the rotor 4 at the base of the vessel 1. The stator 8 is of generally tubular shape and is provided with a stator intake port 10 at its upper end. Above the stator intake port 10 is a media-separating device, such as a screen 9, for separating the milling media from the material being treated, permitting the milled material to pass therethrough into the stator 8 but preventing passage of the milling media. A stator discharge port 11 is provided at the lower end of the stator 8 and communicates with the stator intake port 10 for discharging treated material from the bead mill 1.

The vessel 2, the rotor 4 and stator 8 are configured and dimensioned to form a flow path that extends between the inner surface of the vessel 2 and the outer surface of the rotor 4, through the one or more rotor opening ports 7, and between the inner surface of the rotor 4 and the outer surface of the stator 8. In operation, a predetermined amount of milling media is introduced into the vessel 2 through the milling media supply port 5 and a material to be treated is introduced into the vessel 2 through the material supply port 6. The rotor 4 is rotationally driven and the material is thoroughly stirred and mixed with the milling media while the material gradually advances along the flow path to the stator intake port 10 and then through the interior of the stator 8 for discharge through the stator discharge port 11 while the milling media is circulated around the flow path and is prevented by the media-separating device 9 from entering the stator intake port 10.

As shown in FIGS. 1(A) and 1(B), the vessel 2 has an outwardly extending protruding portion 12 that defines an open chamber or pocket that opens to the flow path. The protruding portion 12 constitutes a wall portion of the vessel 2. An ultrasonic generating device 13, such as a horn-type ultrasonic generator, is mounted to the vessel 2 and extends into the space defined by the protruding portion 12. The protruding portion 12 is preferably located at a part of the vessel 2 that is hardly influenced by the circulating milling media. If desired, an appropriate baffle may be placed between the outer surface of the rotor 4 and the ultrasonic generator 3 to further diminish the influence of the milling media. In the example illustrated, the vessel 2 is provided with one protruding portion 12 and one ultrasonic generator 13; however, the invention is not limited to this arrangement and the vessel 2 may be provided with a plurality of protruding portions and ultrasonic generators at different locations around the vessel.

During operation of the bead mill 1, and as described in more detail hereinbelow, a material to be treated, which in this example is a slurry of solid particles in a liquid, and the milling media are introduced into the vessel 2 and flow into the concave portion 12. When the milling media and material are irradiated with ultrasonic waves generated by the ultrasonic generator 13 while the rotor 4 is rotating at high speed, the solid nano particles vigorously collide with one another and vigorously collide with the milling media. At the same, the milling media also receive the shock waves, which accelerates movement of the milling media. Since the milling media are vigorously stirred in the vessel, the milling media are thoroughly and energetically moved and strong shearing forces are generated by collision of the milling media with one another. The shearing forces generated by collision of the milling media collision of the nano particles with one another and collision of the nano particles against the milling media act in cooperation with one another to extremely finely mill the solid particles so as to obtain desired nano particles. For example, if the milling media consist of beads, the bead would preferably be within a range of 15 μm to 1.0 mm, preferably 0.5 mm to 1.0 mm. By adjusting the bead size within this range, it is possible to assuredly separate the nano particles from the bead by use of a media-separating device, such as the screen 9, a filter, a gap-type separator, etc.

Figure 2:
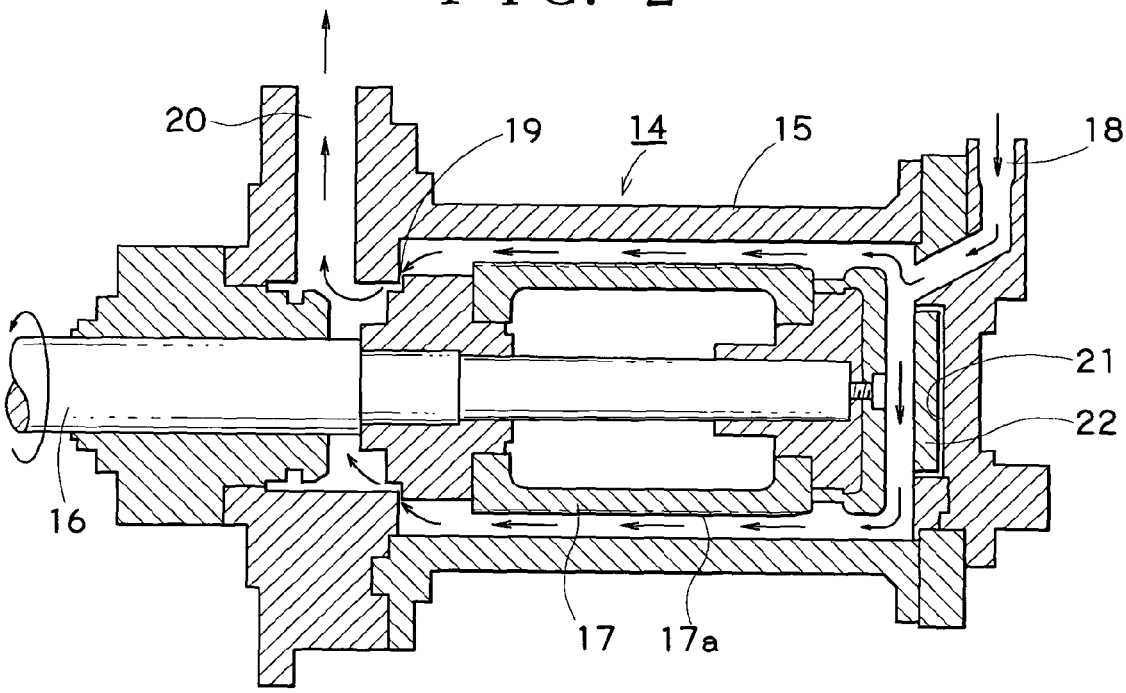
FIG. 2 is a cross-sectional view of a bead mill of system B showing another example of the present invention.

FIG. 2 shows an example of system B, which comprises a bead mill 14 having a vessel 15, which is horizontally disposed, and a rotor 17 rotatably disposed in the vessel 15 and rotationally driven by a driving shaft 16 which is driven by a conventional drive source (not shown). A guide member 17*a* is provided around an outer peripheral surface portion of the rotor 17 for promoting the flow of slurry in a substantially plug-form style as described, for example, in JP-B-4-70050. The vessel 15 has a supply port 18 for introducing milling media, such as beads, into the vessel and for introducing material to be treated, such as a slurry of solid particles in a liquid, into the vessel. A media-separating device 19 in the form of a gap-type separator is disposed at the downstream end of the flow path for preventing the beads from exiting the vessel while permitting the treated material to flow therethrough and exit the bead mill through a discharge port 20.

In the bead mill 14 of system B, the material being treated flows from the forward end side of the vessel 15 to the rotor 17 whereas in the bead mill 1 of system A, the material being treated flows from the rearward end side of the vessel 2 to the rotor 4. Also, the bead mill 1 of system A is of the vertical type in which the material being treated advances vertically while being dispersed and milled whereas the bead mill 14 of system B is of the horizontal type and the material being treated advances horizontally while being dispersed and milled.

At a part of the vessel 14 that faces the forward end of the rotor 17, a recess or open chamber 21 is provided in the vessel 14. The recess or open chamber 21 opens to the flow path. A loading-type ultrasonic generator 22 is disposed within the space 21 for irradiating the beads and the slurry with ultrasonic waves.

During use of the bead mill 14, and as described hereinbelow, after a predetermined quantity of beads are introduced into the vessel 15, the slurry is introduced into the vessel 14 through the supply port 18, the rotor 17 is rotationally driven and the ultrasonic generator 22 is activated to generate ultrasonic waves. As the rotor 17 rotates at high speed, the slurry is stirred and progressively advances through the vessel 15 while the solid particles are dispersed and milled by the circulating beads. The ultrasonic waves cause the nano particles to collide with one another and cause the nano particles to collide with the beads, and in combination with the shearing forces created by the beads during high speed rotation of the rotor 17, the aggregated nano particles are milled and dispersed to nearly primary size. The size of the beads is within a range of 15 μm to 1.0 mm, and preferably 0.5 mm to 1.0 mm. By adjusting the bead size within this range, it is possible to assuredly separate the milled and dispersed nano particles from the beads by the media-separating device 19.

Figure 3:
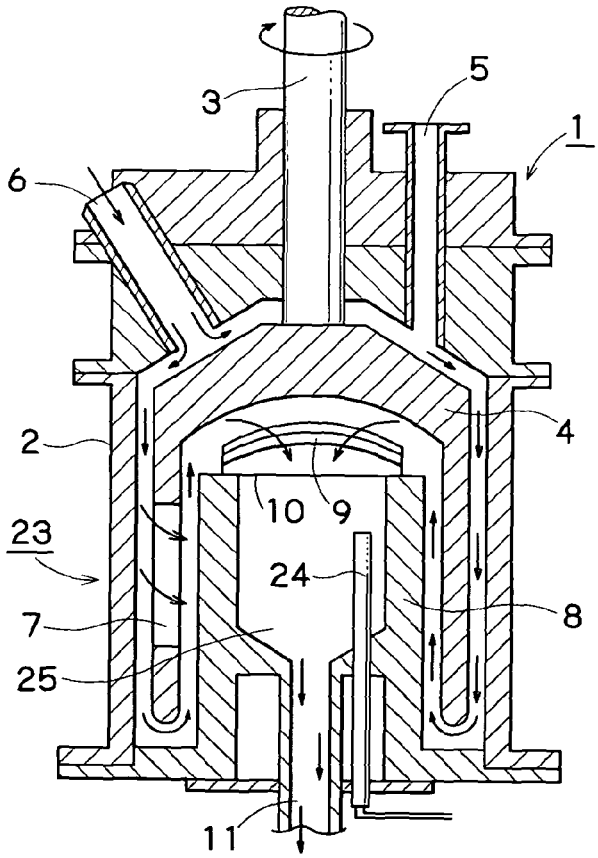
FIG. 3 is a cross-sectional view of a bead mill of system C showing another example of the present invention.

FIG. 3 shows an example of system C which comprises a bead mile 23. The bead mill 23 has some parts that are the same as those of the bead mill 1 shown in FIG. 1(A), and the same or similar parts are denoted by the same reference numbers and explanation thereof is omitted. In the bead mill 23, no protruding portion for accommodation of an ultrasonic horn is provided in the vessel. Instead, a horn-type ultrasonic generator 24 is disposed in a space 25 inside the stator 8 where the treated material flows after passing through the media-separating screen 9 and before reaching the discharge port 11.

In operation, a material to be treated, such as a slurry of solid particles in a liquid, is introduced inside the vessel 1 and before passing through the screen 9, the particles are dispersed and milled by the shearing forces of the beads created by high speed rotation of the rotor 4. After the milled particles pass through the screen 9 and before reaching the discharge port 11, the ultrasonic horn 24 irradiates the particles with ultrasonic waves causing vigorous collision of nano particles with one another within the space 25. In this manner, both actions (shearing and ultrasonic wave irradiation) are applied at substantially the same time, whereby aggregated nano particles are milled and dispersed to nearly primary particle size. The size of the beads is within a range of 15 μm to 1.0 mm, preferably 0.5 mm to 1.0 mm. By adjusting the bead size relative to this range, it is possible to conduct separation of nano particles and beads by use of a media-separating device, such as the screen 9, a gap-type separator, a filter, etc.

Figure 4:
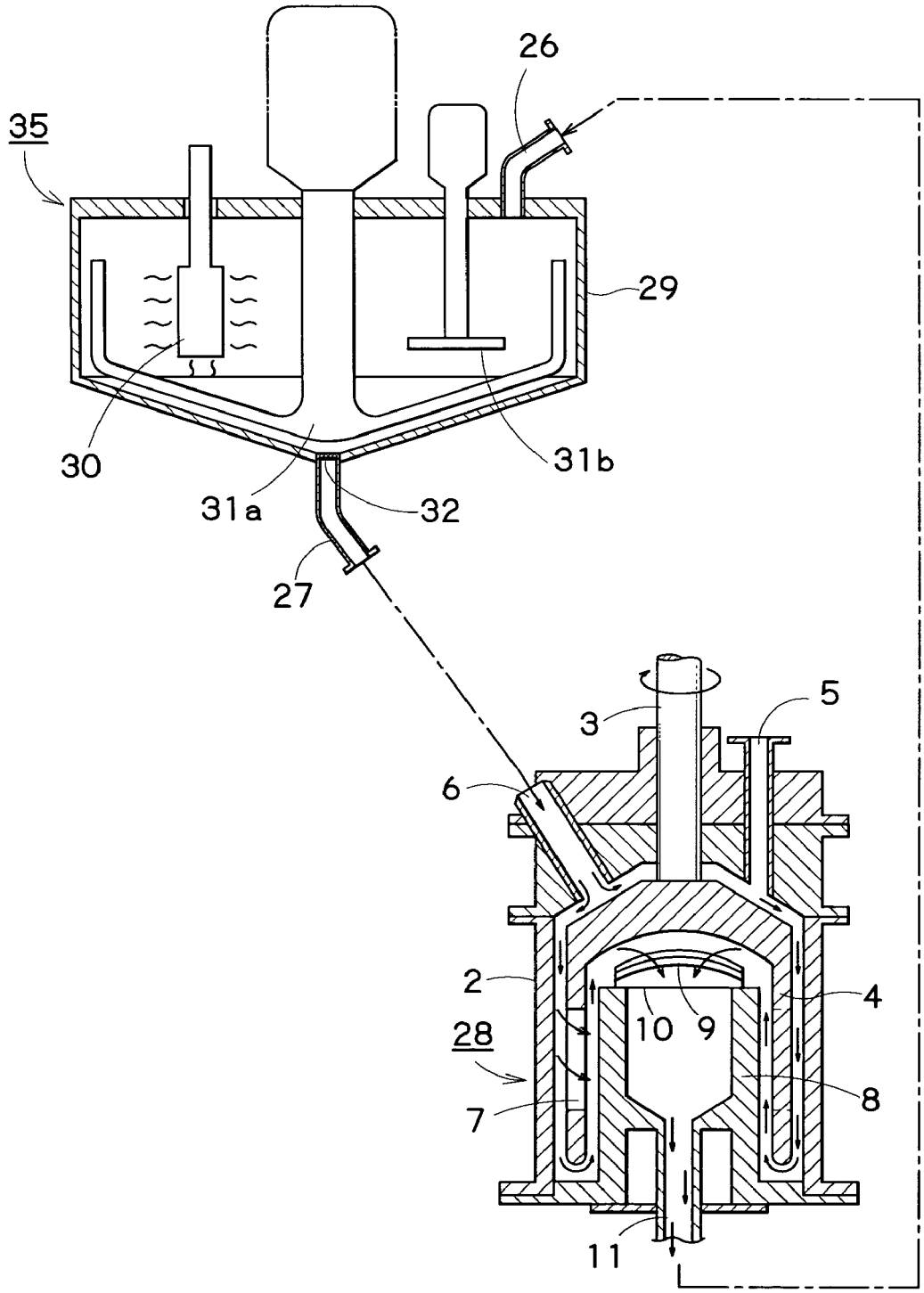
FIG. 4 is a cross-sectional view of an apparatus of system D showing a further example of the present invention.

FIG. 4 shows an apparatus illustrating an example of system D, which comprises a bead mill 28 and a mixer 35. The bead mill 28 is generally similar to the bead mill 1 of system A except for provision of the ultrasonic generator on the vessel 2. The same reference numerals have been used in FIG. 4 to denote the same or similar parts used in FIG. 1(A) and a detailed description thereof is omitted. In the bead mill 28, the vessel 2 is not provided with one or more protruding portions for housing one or more ultrasonic generators and instead, the ultrasonic generator is housed within the mixer 35.

The mixer 35 comprises a tank 29 which, in this example, is a closed tank, for receiving a material to be treated, such as a slurry of solid particles in a liquid, and milling media, such as beads. The tank 29 has a flow-in port 26 connected to receive milled and dispersed nano particles and liquid discharged from the discharge port 11 of the bead mill 28, and a flow-out port 27 connected to supply the slurry to the supply port 6 of the bead mill 28. An ultrasonic generator 30 is disposed within the tank 29 for generating and propagating ultrasonic waves within the tank. One or more sets of stirring vanes 31*a* and 31*b* are provided in the tank 29 and are rotated by drive motors for stirring and mixing the slurry and beads. A media-separating device 32 is provided at the inlet of the flow-out port 27 for separating the nano particles and beads so that only the nano particles are discharged into the flow-out port 27 for introduction into the supply port 6 of the bead mill 28. The media-separating device 32 may be a screen, filter, gap-separator or the like. Where the size of the beads is within a range of 0.5 mm to 1.0 mm, a screen is desirable, and when the size of the beads is within a range of 15 μm to 0.5 mm, a filter is desirable.

The size of the beads is selected in relation to the amplitude of the ultrasonic waves generated by the ultrasonic generator 30. It has been found that when the amplitude of the ultrasonic waves is large, movement of the beads within the slurry is possible even if the beads are relatively large, and therefore collision of the nano particles with one another and collision of the nano particles with the beads can be effectively achieved when the bead size is within the range of 15 μm to 1.0 mm, whereby milling and dispersion can be conducted to nearly primary particle size. On the other hand, when the amplitude of the ultrasonic waves is small, the propagation of the ultrasonic waves does not create sufficient bead movement and it is therefore necessary to use smaller beads. The optimum quantity of beads to be used is determined based on the concentration of particles in the slurry to be treated. In the case of a thin slurry, the amount of beads is necessarily large whereas in the case of a thick slurry, the amount of beads is necessarily small.

As the milling media in the case where the ultrasonic generator is disposed in the vessel, preferably employed are fine beads of such a size that they can be moved by the shock waves generated by decay of cavitation caused by the ultrasonic waves, i.e., beads having a relatively small particle size as compared with the ones used for conventional general-purpose media dispersing apparatus, and it is preferred to have a size at such a level that can be separated by a media-separating device such as a screen, filter, gap-separator and the like.

Specifically, according to the results of experiments, even with a method of using a filter and a method by way of centrifugal separation, in order to separate nano particles having an average particle size of at most 100 nm, the particle size of milling media is required to be at least about 15 μm, and it is difficult to conduct separation with a particle size less than this size. More preferred is a manner of using a screen by which classification can be assuredly made, and the particle size of the beads is more preferably at least 0.5 mm. Further, when the particle size of the beads exceeds 1.0 mm, it becomes difficult to conduct sufficient movement of the milling media by shock waves generated by ultrasonic waves, and as the result, it is impossible to make aggregated nano particles effectively collide against the milling media.

In order to move larger milling media, it is required to generate larger cavitation and conduct decay thereof. Further, when the concentration of particles is high, it is desirable to use the milling media in a relatively small amount, and when the concentration of particles is low, it is desirable to use the milling media in a relatively large amount.

As the material of the milling media, an optimum material is selected depending on the application of the dispersing or milling apparatus according to the present invention, for example, engineering plastics, glass, ceramics, steel, etc. may be used. A zirconia-based material is preferred for the application susceptible to corrosion or breakage.

As a solvent when nano particles are treated by the dispersing or milling apparatus according to the present invention, an organic solvent such as various types of alcohols, cyclohexane, methyl ethyl ketone, methyl acetate, toluene, hexane, etc. may be used.

When the ultrasonic generator is disposed in the vessel, the ultrasonic-generating device is required to have such a frequency and amplitude that can cause energetic collision of the nano particles with one another by shockwaves produced by cavitation generated by irradiation with ultrasonic waves and, at the same time, can vigorously move the milling media. According to the results of experiments, when the frequency of the ultrasonic waves is about 15 KHz to 30 KHz and the amplitude is about 5 μm to 50 μm, it is possible to generate large cavitation, make the shock waves at the time of decay strong, and apply sufficient movement to the aggregated nano particles and milling media. More preferably, the frequency of the ultrasonic waves is 15 KHz to 20 KHz, and the amplitude thereof is 20 μm to 50 μm.

Figure 5:
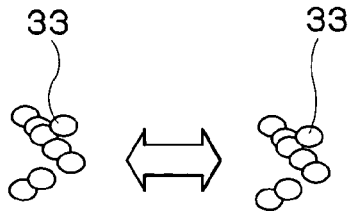
FIG. 5 is an explanatory view on an exaggerated scale illustrating the action on nano particles by a conventional ultrasonic dispersing apparatus.
Figure 6:
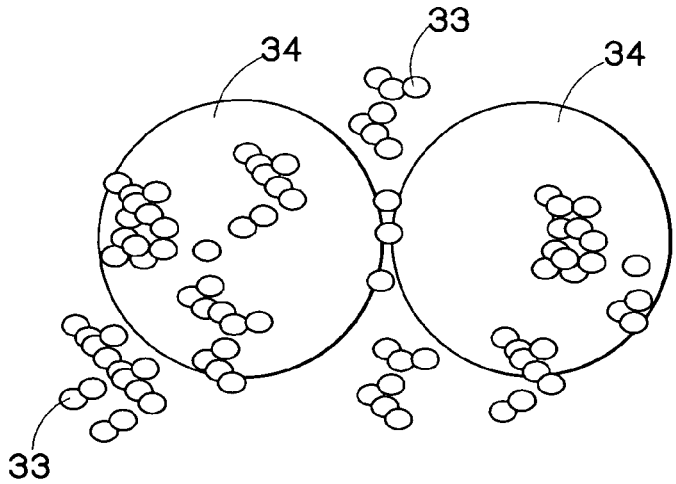
FIG. 6 is an explanatory view on an exaggerated scale illustrating the action on nano particles by a conventional bead mill.
Figure 7:
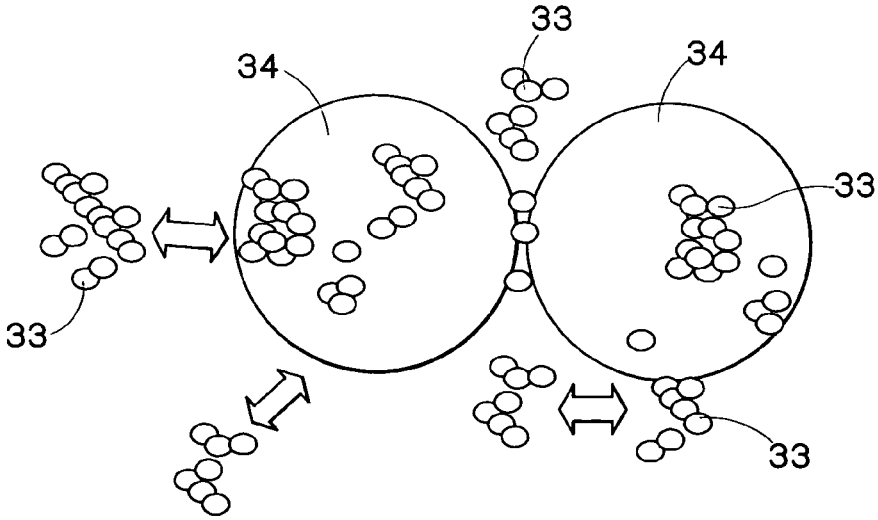
FIG. 7 is an explanatory view on an exaggerated scale illustrating the action on nano particles by the bead mill of the present invention.

The differences between the case of the above bead mills in combination with ultrasonic waves and the cases where dispersion and milling are conducted by using a simple ultrasonic-dispersing device or conventional bead mills, will be briefly explained below. In the cases where only an ultrasonic-dispersing device is used, as shown in FIG. 5, the collision caused by shock waves is only the collision among aggregated nano particles 33. In the cases where only a bead mill is used, as shown in FIG. 6, only shearing forces generated between milling media 34 is used, and such a method does not positively collide nano particles 33 against the milling media 34. By contrast, in the case of a bead mill using ultrasonic waves in combination, as shown in FIG. 7, since shock waves created by ultrasonic waves are applied to the milling media 34, aggregated nano particles 33 receive shearing forces, and collision among the nano particles and collisions between the nano particles and the milling media are caused by irradiation with ultrasonic waves, whereby the particles are effectively and finely divided and it becomes possible to sufficiently disperse and mill nano particles.

Hereinbelow, examples of the present invention will be described in detail. However, it should be noted that the present invention is by no means restricted by these examples.

EXAMPLE 1

An apparatus as shown in FIG. 1(A) was used wherein a pocket is formed at a part of a vessel of system A and a horn-type ultrasonic generator was disposed inside the pocket. More specifically, a protruding portion 12 was formed on an inner wall of a vessel 2, and an ultrasonic horn 13 as an ultrasonic-generating device was disposed in the protruding portion 12. The ultrasonic waves had an amplitude of 50 μm and a frequency of 20 KHz. The bead mill was operated at a circumferential speed of 4 m/s and a slurry-supplying rate of 10 mL/s for treatment. An aqueous slurry obtained by adding 10 vol % of P25 powder, i.e., nanoparticulate P25 (Nippon Aerosil Co., Ltd., Tokyo, Japan) with a primary particle size of 35 nm made of titanium oxide nano particles and, as a polymer dispersing agent, polyacrylic acid ammonium salt with a molecular weight of 8,000 added in an amount of 0.5 $mg/m^2$ per surface area of particles, was pre-treated for 30 minutes by using rotating vanes at 500 rpm. Using 3 liters of this slurry and the above apparatus, experiment of dispersion was conducted up to 5 hours. Using a granulometric meter of an ultrasonic wave attenuation system, particle size in the slurry was measured while the concentration of particles was kept at 10 vol %. The particle sizes, measured each hour for 5 hours, are indicated in Table 1.

EXAMPLE 2

An apparatus as shown in the FIG. 2 of system B was used. Specifically, a slurry flows from the forward end side of a vessel to a rotor contrary to the slurry flow direction in system A. The experiment of dispersion was conducted in the same manner as in Example 1 using a loading-type ultrasonic generator disposed in a space formed on a side opposite to the forward end of the rotor. Particle sizes measured every hour for 5 hours are indicated in Table 1.

EXAMPLE 3

An apparatus of system C as shown in FIG. 3 was used. Specifically, a horn-type ultrasonic generator was disposed in a space inside the stator where the slurry accumulates after passing through a screen and before reaching a discharge port. Other than this feature, the same experiment of dispersion as in Example 1 was conducted. Particle sizes, measured hourly for 5 hours, are indicated in Table 1.

EXAMPLE 4

An apparatus of system D as shown in FIG. 4 was used. Specifically, a bead mill using zirconia-based beads of 0.5 mm was used, and a mixer which functioned as a slurry supply tank and recovery tank (supply/recovery tank) was disposed in a circulation system thereof, and a 0.1 liter portion of zirconia-based balls of 50 μm was poured into the mixer. A 25 μm-mesh filter was disposed to conduct classification of the beads and nano particles in the slurry. Further, the tank was equipped with an ultrasonic generator with a frequency of 20 KHz and an amplitude of 50 μm. The bead mill was operated at a circumferential speed of 4 m/s and a slurry-supplying rate of 10 mL/s for treatment. An aqueous slurry obtained by adding 10 vol % of P25 powder, i.e., nanoparticulate P25 (Nippon Aerosil Co., Ltd., Tokyo, Japan) with a primary particle size of 35 nm made of titanium oxide nano particles and, as a polymer dispersing agent, polyacrylic acid ammonium salt with a molecular weight of 8,000 added in an amount of 0.5 $mg/m^2$ per surface area of particles, was pre-treated for 30 minutes by using rotating vanes at 500 rpm. Using 3 liters of this slurry and the above apparatus, experiment of dispersion was conducted up to 5 hours. Using a granulometric meter of an ultrasonic wave attenuation system, the size of particles in the slurry was measured while the concentration of particles was kept at 10 vol %. The particle sizes measured every hour for 5 hours are indicated in Table 1.

EXAMPLE 5

Experiment of dispersion was conducted in the same manner as in Example 4 except that the size of beads put in the mixer, which functioned as both a supply tank and a recovery tank, was changed to 0.5 mm and the screen for separation of beads and nano particles was changed to 0.2 mm. Particle sizes measured every hour for 5 hours are indicated in Table 1.

EXAMPLE 6

Experiment of dispersion was conducted in the same manner as in Example 4 except that the slurry in the mixer which functioned as both a supply tank and a recovery tank was irradiated with ultrasonic waves with a frequency of 20 KHz and an amplitude of 20 μm. Particle sizes measured hourly for 5 hours are indicated in Table 1.

EXAMPLE 7

Experiment of dispersion was conducted in the same manner as in Example 4 except that the slurry in the tank mixer which functioned as both a supply tank and a recovery tank was irradiated with ultrasonic waves with a frequency of 20 KHz and an amplitude of 20 μm, the size of beads put in the mixer was changed to 0.5 mm, and the screen for classification of the beads and nano particles was changed to 0.2 mm. Particle sizes measured every hour for 5 hours are indicated in Table 1.

Comparative Example 1

Experiment of dispersion was conducted in the same manner as in Example 4 except that no beads were put in the mixer which functioned as both a supply tank and a recovery tank, and no irradiation with ultrasonic waves was conducted. Particle sizes measured every hour for 5 hours are indicated in Table 1.

Comparative Example 2

Experiment of dispersion was conducted in the same manner as in Example 4 except that no beads were put in the mixer which functioned as both a supply tank and a recovery tank. Particle sizes measured each hour for 5 hours are indicated in Table 1.

Comparative Example 3

Experiment of dispersion was conducted in the same manner as in Example 4 except that the slurry in the mixer which functioned as both a supply tank and a recovery tank was irradiated with ultrasonic waves with a frequency of 20 KHz and an amplitude of 20 μm, and no beads were put in the mixer. Particle sizes measured every hour for 5 hours are indicated in Table 1.

Comparative Example 4

Experiment of dispersion was conducted in the same manner as in Example 4 except that the slurry in the mixer which functioned as both a supply tank and a recovery tank was irradiated with ultrasonic waves with a frequency of 40 KHz and an amplitude of 5 μm, and no beads were put in the mixer. Particle sizes measured every hour for 5 hours are indicated in Table 1.

TABLE 1

| | Apparatus (beads mill) | Ultrasonic irradiation condition | Size of beads at the time of ultrasonic irradiation | Treatment time 1 hr | 2 hr | 3 hr | 4 hr | 5 hr |
|---|---|---|---|---|---|---|---|---|
| Ex. 1 | A system (FIG. 1) | A condition | 0.5 mm | 80 nm | 70 nm | 60 nm | 50 nm | 50 nm |
| Ex. 2 | B system (FIG. 2) | A condition | 0.5 mm | 70 nm | 60 nm | 60 nm | 50 nm | 50 nm |
| Ex. 3 | C system (FIG. 3) | A condition | 0.5 mm | 90 nm | 80 nm | 70 nm | 60 nm | 60 nm |
| Ex. 4 | D system (FIG. 4) | A condition | 0.05 mm | 60 nm | 52 nm | 50 nm | 48 nm | 45 nm |
| Ex. 5 | D system (FIG. 4) | A condition | 0.5 mm | 60 nm | 48 nm | 50 nm | 50 nm | 48 nm |
| Ex. 6 | D system (FIG. 4) | B condition | 0.05 mm | 60 nm | 50 nm | 50 nm | 48 nm | 48 nm |
| Ex. 7 | D system (FIG. 4) | B condition | 0.5 mm | 80 nm | 70 nm | 70 nm | 70 nm | 70 nm |
| Comp. 1 | D system (FIG. 4) | No irradiation | None | 300 nm | 180 nm | 150 nm | 150 nm | 150 nm |
| Comp. 2 | D system (FIG. 4) | A condition | None | 180 nm | 150 nm | 110 nm | 110 nm | 110 nm |
| Comp. 3 | D system (FIG. 4) | B condition | None | 200 nm | 160 nm | 120 nm | 120 nm | 120 nm |
| Comp. 4 | D system (FIG. 4) | C condition | None | 190 nm | 180 nm | 140 nm | 140 nm | 140 nm |

* Ultrasonic irradiation condition A: Frequency of vibration = 20 KHz, amplitude = 50 μm
* Ultrasonic irradiation condition B: Frequency of vibration = 20 KHz, amplitude = 20 μm
* Ultrasonic irradiation condition C: Frequency of vibration = 40 KHz, amplitude = 5 μm From these experiments, it can be seen that the apparatus and method of the present invention are superior to those conventionally used and produce nano particles of significantly smaller size than has heretofore been obtained.

It will be appreciated by those skilled in the art that obvious changes can be made to the embodiments and examples described in the foregoing description without departing from the broad inventive concept thereof. It is understood, therefore, that this disclosure is not limited to the particular embodiments and examples disclosed, but is intended to cover all obvious modifications thereof which are within the scope and the spirit of the disclosure as defined by the appended claims.

What is claimed is:

1. A dispersing or milling apparatus comprising: a vessel that receives milling media and a material to be treated containing solid particles in a liquid; means for stirring the material together with the milling media in the vessel to mill and disperse the solid particles in the liquid; and an ultrasonic generator that generates ultrasonic waves in the liquid to assist in milling and dispersing the solid particles in the liquid, wherein the vessel has a recessed wall portion that opens to the inside of the vessel, and the ultrasonic generator is disposed in the space defined by the recessed wall portion.

2. A dispersing or milling apparatus according to claim 1; wherein the ultrasonic generator generates ultrasonic waves having a frequency of about 15 KHz to 30 KHz and an amplitude of about 5 mm to 50 mm.

* * * * *